United States Patent [19]

Sasaki et al.

[11] Patent Number: 4,742,706

[45] Date of Patent: May 10, 1988

[54] STRAIN IMPARTING DEVICE

[75] Inventors: Eiji Sasaki; Mitsuo Murata; Hisashi Kobayashi; Katsuro Kuroki, all of Kitakyushu; Hisao Kitsunezaki; Kengo Yoshioka, both of Chiyoda; Mikio Nakamura, Kitakyushu, all of Japan

[73] Assignees: Nippon Steel Corporation; Nittetsu Plant Designing Corporation, both of Japan

[21] Appl. No.: 857,649

[22] Filed: Apr. 29, 1986

[30] Foreign Application Priority Data

Oct. 14, 1985 [JP] Japan ..... 60-226699
Oct. 14, 1985 [JP] Japan ..... 60-226700

[51] Int. Cl.[4] ..... B21B 3/02; B21B 13/14

[52] U.S. Cl. ..... 72/197; 72/242

[58] Field of Search ..... 72/241–243, 72/196, 197, 703; 148/111, 120

[56] References Cited

U.S. PATENT DOCUMENTS 2,828,654 4/1958 Ungerer ..... 72/465
3,429,166 2/1969 Baker et al. ..... 72/245
4,533,409 8/1985 Benford ..... 148/111
4,539,834 9/1985 Iwanami ..... 72/243
4,603,569 8/1986 Sendzimir ..... 72/243

FOREIGN PATENT DOCUMENTS 2354942 5/1975 Fed. Rep. of Germany ..... 72/243
32076 10/1975 Japan ..... 72/243
604597 4/1978 U.S.S.R. ..... 72/197

*Primary Examiner*—Lowell A. Larson
*Attorney, Agent, or Firm*—Kenyon & Kenyon

[57] ABSTRACT

A device for imparting strain to a steel sheet by which deformed regions spaced at a desired distance and having a minute linear shape are continuously formed, comprising: a strain imparting roll having projected portions on the surface thereof; a press roll provided opposite to the strain imparting roll; a row of a plurality of groups of back-up rolls for pressing against the press rolls, provided with spaces of a desired distance therebetween in a longitudinal direction of the press roll; and a fluid pressure cylinder connected to each group of the back-up rolls via a bearing, and a fluid supply source connected to the fluid pressure cylinder.

1 Claim, 3 Drawing Sheets

STRAIN IMPARTING DEVICE

BACKGROUND OF THE INVENTION

1. Field of the Invention

The present invention relates to a strain imparting device for a grain oriented electrical steel sheet. More particularly, it relates to a strain imparting device for producing a low watt loss electrical steel sheet by imparting small linear deformation regions, hereinafter referred to as minute strain, to surfaces of an oriented electrical steel sheet.

2. Description of the Related Art

In the past, to reduce the watt loss of the electrical steel sheet (hereinafter referred to as steel sheet), a process for imparting minute-strain to a surface of a steel sheet has been used. For example, Japanese Unexamined patent publication No. 56-36341 discloses that linear strain is imparted to a surface of a steel sheet while rotating a hard globular rotator. Further, Japanese Unexamined patent publication No. 55-92227 discloses that linear strain is imparted to a steel sheet by pressing a strain imparting block, against a surface of steel sheet within which block a retractable shaft having rotating-pressing rings at the ends thereof is transversly provided.

However, above-mentioned processes are disadvantageous in that the constitutions thereof are composite, the life of a device used in the process is not sufficient, and since it is necessary to stop movement of the steel sheet during the process, the processes is not efficient.

SUMMARY OF THE INVENTION

It is an object of the present invention to solve the above-mentioned problems.

It is a further object of the present invention to provide a strain imparting device wherein continuous and minute strain is efficiently and uniformly imparted by a simple constitution without stopping the movement of steel sheet.

It is a still further object of the present invention to provide a strain imparting device wherein a uniform strain is efficiently and continuously imparted to the surface of the steel sheet while weaving back and forth and changing the width thereof during passage over the surface of the steel sheet.

According to the present invention there is provided a device for imparting strain to a steel sheet by which deformed regions spaced at a desired distance and having a minute linear shape are continuously formed, comprising: a strain imparting roll having projected portions on the surface thereof; a press roll provided opposite to the strain imparting roll; a row of a plurality of groups of back-up rolls for pressing against the press roll, provided with spaces of a desired distance therebetween in a longitudinal direction of the press roll; a fluid pressure cylinder connected to each group of the back-up rolls via bearings; and a fluid supply source connected to each fluid pressure cylinder.

According to the present invention there is further provided a device for imparting strain to a steel sheet by which deformed regions spaced at a desired distance and having a minute linear shape are continuously formed, comprising: a strain imparting roll having projected portions on the surface thereof; a press roll opposingly provided opposite to the strain imparting roll; a row of a plurality of groups of back-up rolls for pressing against the press roll, provided with spaces of a desired distance therebetween in a longitudinal direction of the press roll; a fluid-pressure cylinder connected to each group of the back-up rolls via bearings; and a fluid supply source connected to each fluid pressure cylinder via each selective changeover valve; the back-up rolls for pressing against the press roll being selectively operated.

By the strain imparting device of the present invention the pressure can be uniformly imparted to the steel sheet at occurrence of width changing and weaving steel sheet.

According to the present invention there is still further provided a device for imparting strain to a steel sheet by which deformed regions spaced at a desired distance and having a minute linear shape are continuously formed, comprising: a strain imparting roll having projected portions on the surface thereof; a press roll provided opposite to the strain imparting roll; a row of a plurality of groups of first back-up rolls for pressing against the press roll, provided with spaces of a desired distance therebetween in a longitudinal direction of the press rolls; a first fluid pressure cylinder connected to each group of the first back-up rolls via bearings; a first fluid supply source connected to each first fluid pressure cylinder via each selective changeover valve; a pair of groups of second back-up rolls provided at both outer sides of the first back-up rolls; each second fluid pressure cylinder being connected to each group of the second back-up rolls via a bearing; and a second fluid supply source connected to each second fluid pressure cylinder.

By the strain imparting device of the present invention the discrepancy between the center of gravity of the press roll and the center of the weaving steel sheet is not generated so that uniform pressure against the steel sheet can be obtained.

DESCRIPTION OF THE PREFERRED EMBODIMENTS

Figure 1:
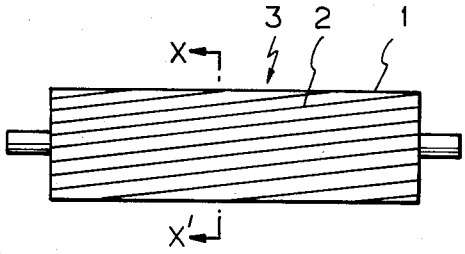
FIG. 1 is a side view of a strain imparting roll according to the present invention.
Figure 2:
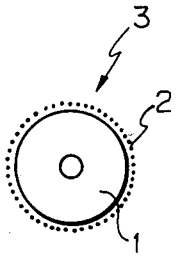
FIG. 2 is a cross-sectional view taken along the line X—X' of FIG. 1.

FIG. 1 is a side view of a strain imparting roll according to the present invention, and FIG. 2 is a cross-sectional view taken along the line X—X' of FIG. 1.

As shown in FIGS. 1 and 2 a strain imparting roll 3 is formed by a bar shaped body 1 and spiral projections 2 provided on the bar shaped body 1.

The spiral projections 2 can have either a left or right spiral winding direction or be composed in both a left and right spiral winding direction. The winding pitch of the spiral projections may be suitably formed in a range of from about 1 to 20 mm. The top of the projected portion of the spiral projections can be any shape, provided that the surface of the steel sheet is not damaged by the projections. Further any spiral angle of the projections can be used, within a range of from 5 to 85 degrees. As the material of the bar shaped body 1, steel, aluminum or hard plastic are used.

Figure 3:
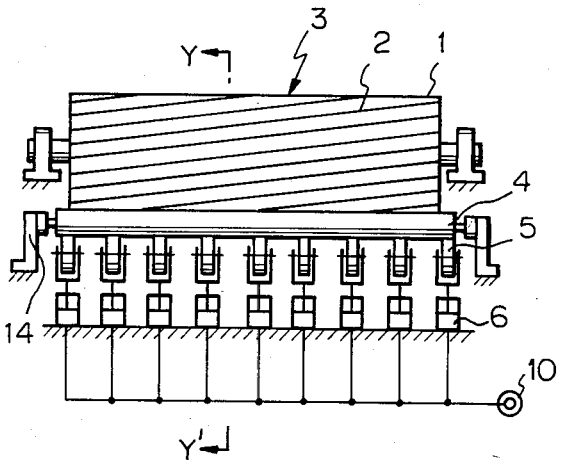
FIG. 3 is a side view of a strain imparting device according to the present invention.
Figure 4:
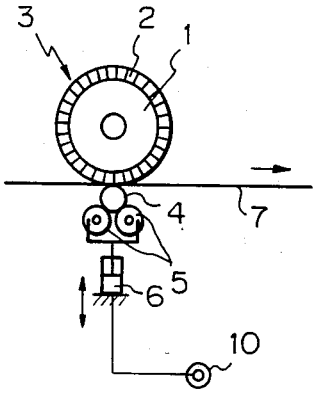
FIG. 4 is a cross-sectional view taken along line Y—Y' of FIG. 3.

FIG. 3 is a side view of a strain imparting device according to the present invention, and FIG. 4 is a cross-sectional view taken along the line Y—Y' of FIG. 3.

As shown in FIGS. 3 and 4, a strain imparting roll 3 is provided opposite to a press roll 4 which is pressed upward by a plurality of back-up rolls 5 arranged in a longitudinal direction. Each pair of back-up rolls 5 is pressed upward by a pressing cylinder 6, is used so that each respective back-up roll 5 presses against the press roll 4 with the same liquid or air pressure.

Since the press roll 4 has the flexibility that it follows the surface of the steel sheet and the rigidity that it can uniformly press the steel sheet, it is in constantly uniform contact with a steel sheet 7 to be passed through between the press roll 4 and the strain imparting roll 3.

Further, since the press roll 4 is uniformly pressed by a plurality of pairs of back-up rolls 5 exerting identical upward pressure and spaced at a constant distance, it exerts a uniform pressure on the steel sheet 7, thereby forming minute strain regions on the surface of the steel sheet. In this strain imparting process, the press roll 4 and the strain imparting roll 3 may be either an idler roll or a drive roll.

A thrust bearing 14 acts in the manner that thrust force generated in the press roll 4 can be canceled and the press roll 4 can be supported to a desired position. The thrust force is a total of thrust force imparted by the strain imparting roll 3 through the steel sheet and thrust force generated by an irregular arrangement. The supporting of the press roll 4 by the thrust bearing 14 at the side thereof, results in canceling the thrust force imparted by the strain imparting roll to the steel sheet.

Figure 5:
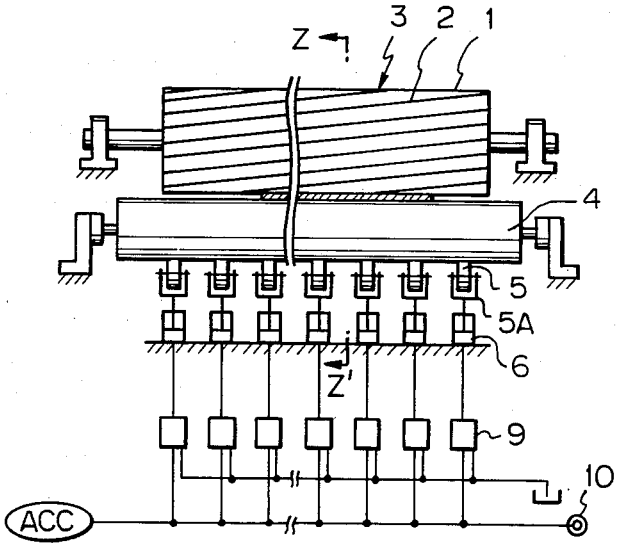
FIG. 5 is a side view of another strain imparting device according to the present invention.
Figure 6:
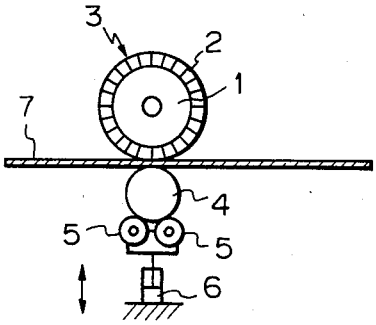
FIG. 6 is a cross-sectional view taken along the line Z—Z' of FIG. 5.

FIG. 5 is a side view of another strain imparting device according to the present invention, and FIG. 6 is a cross-sectional view taken along the line Z—Z' of FIG. 5.

As shown in FIGS. 5 and 6 a strain imparting roll 3 having spiral projections 2 on the surface thereof, a press roll 4, and back-up rolls 5 consisting of a plurality of pairs of rolls, are arranged in substantially the same manner as shown in FIGS. 3 and 4.

Each pair of back-up rolls 5 is connected to each a pressure cylinder 6 via a bearing 5A, which is connected to a fluid supply source 10 via a changeover valve 9 for selecting the flow rate of the fluid.

In this example shown in FIGS. 5 and 6, the press roll 4 is pressed up by the back-up rolls 5. The pressure on the steel sheet 7 can be adjusted to a desired pressure by using the changeover valve 9. In accordance with a position of the steel sheet 7 passing between the strain imparting roll 3 and the press roll 4, only changeover valves 9 relating to the back-up rolls 5 under the steel sheet can be selectively excited so that only the back-up rolls 5 under the steel sheet are pressed up, and thus uniform minute strain regions can be imparted to the surface of the steel sheet 7 through a press roll 4 regardless of the weaving movement of the steel sheet 7.

Figure 7:
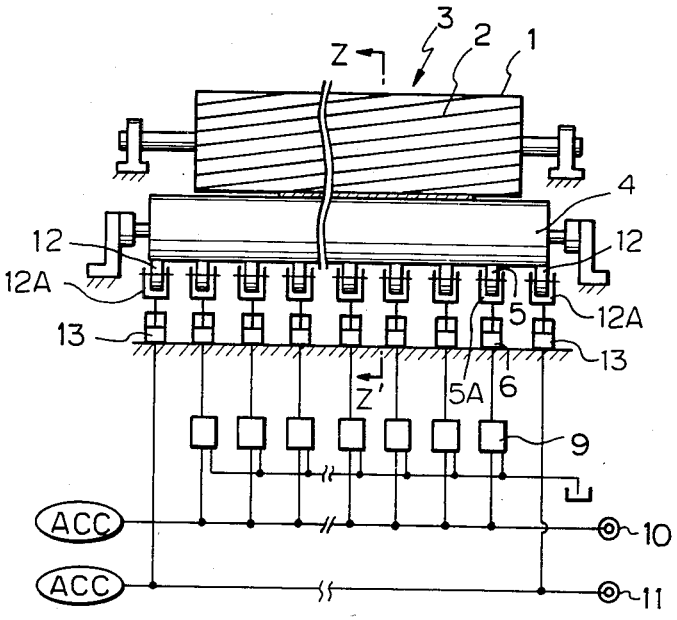
FIG. 7 is a side view of still another strain imparting device according to the present invention.

FIG. 7 is a side view of still another strain imparting device according to the present invention.

As shown in FIG. 7, a pair of back-up rolls 12 with bearings 12A is provided at both side ends of the above explained back-up rolls 5. The respective back-up rolls 12 positioned at both side ends are connected to a fluid pressure cylinder 13 connected to another fluid supply source 11 different from the fluid supply source 10. The remaining construction of FIG. 7 is substantially the same as that shown in FIG. 5, and the back-up rolls 5, fluid pressure cylinders 6, and changeover valves 9 are operated in the same manner as explained in FIG. 5. A cross-sectional view taken along the line Z—Z' of FIG. 7 is the same as in FIG. 6.

The two pair of back-up rolls 12 are provided so that a phenomenon wherein a uniform strain cannot be normally imparted to the surface, at the occurrence of width changing and weaving steel sheet due to the weight of the press roll 4 can be prevented by pressing up the press roll 4. The pressure for pressing up the press roll 4 which pressure is originated from hydraulic or pneumatic pressure source 11 is adjusted at ends of back up rolls 12 to the identical value and to the weight of the press roll 4 so that the weight of the press roll 4 can be cancelled and the difference between the moment in both ends of the press roll 4 due to the differences between the length of both side ends extending over the ends of the passing steel sheet 7 can be cancelled, whereby a uniform strain can be imparted to the surface of the steel sheet 7 even if the steel sheet 7 passing between the strain imparting roll 3 and the press roll 4 is weaved and the width of the steel sheet 7 is changed. In the present invention various shapes and material can be used as the projections of the surface of the bar shaped body 1.

We claim:

1. A device for imparting strain to a steel sheet by which deformed regions spaced at a desired distance and having a minute linear shape are continuously formed, comprising:

a strain imparting roll having projected portions on the surface thereof;

a press roll provided oppoiste to said strain imparting roll;

a row of a plurality of groups of first back-up rolls for pressing against said press roll provided with spaces of a desired distance therebetween in a longitudinal direction of the press roll;

a plurality of first fluid pressure cylinders, one connected to each group of the first back-up rolls via a bearing;

a first fluid supply source connected to said first fluid pressure cylinders via a plurality of selective changeover valves, one connected between each said cylinder and said source;

a pair of groups of second back-up rolls provided at both outer ends of said first back-up rolls;

a pair of second fluid pressure cylinders, one connected to each group of the second back-up rolls via a bearing; and a second fluid supply source connected to said second fluid pressure cylinders.

* * * * *

UNITED STATES PATENT AND TRADEMARK OFFICE

CERTIFICATE OF CORRECTION

PATENT NO. : 4,742,706

DATED : May 10, 1988

INVENTOR(S) : E. Sasaki, et al.

It is certified that error appears in the above-identified patent and that said Letters Patent is hereby corrected as shown below:

Column 1, line 23, after "block" insert a comma.

Column 1, line 31, change "during the process" to -- during the processes-- and change "the processes is" to --the processes are--.

Column 2, line 11, before "steel sheet" insert --of the--.

Column 3, line 2, after "Further" insert a comma.

Column 4, line 15, change "pair" to --pairs--.

Column 4, line 18, between "weaving" and "steel" insert --of the--.

Column 4, line 21, after "press roll 4" insert a comma.

Column 4, line 22, after "source 11" insert a comma.

UNITED STATES PATENT AND TRADEMARK OFFICE

CERTIFICATE OF CORRECTION

PATENT NO. : 4,742,706

DATED : May 10, 1988

INVENTOR(S) : E. Sasaki, et al.

It is certified that error appears in the above-identified patent and that said Letters Patent is hereby corrected as shown below:

Column 4, line 43, change "oppoiste" to --opposite--.

Signed and Sealed this

Eighteenth Day of October, 1988

*Attest:*

DONALD J. QUIGG

*Attesting Officer*

*Commissioner of Patents and Trademarks*